US010161405B2

(12) United States Patent
Tamaoka et al.

(10) Patent No.: US 10,161,405 B2
(45) Date of Patent: Dec. 25, 2018

(54) COOLING APPARATUS

(71) Applicant: NIDEC CORPORATION, Kyoto (JP)

(72) Inventors: Takehito Tamaoka, Kyoto (JP); Kazuhiko Fukushima, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 164 days.

(21) Appl. No.: 14/483,843

(22) Filed: Sep. 11, 2014

(65) Prior Publication Data

US 2015/0110649 A1 Apr. 23, 2015

Related U.S. Application Data

(60) Provisional application No. 61/892,667, filed on Oct. 18, 2013.

(51) Int. Cl.
*F04D 25/06* (2006.01)
*F04D 25/08* (2006.01)
(Continued)

(52) U.S. Cl.
CPC ..... *F04D 25/0613* (2013.01); *F04D 17/16* (2013.01); *F04D 25/062* (2013.01);
(Continued)

(58) Field of Classification Search
CPC ... F04D 25/0613; F04D 25/0693; F04D 25/08
(Continued)

(56) References Cited

U.S. PATENT DOCUMENTS 6,348,748 B1 2/2002 Yamamoto
6,896,046 B2 * 5/2005 Lee ..... H01L 23/467 165/121
(Continued)

FOREIGN PATENT DOCUMENTS

CN 2498381 Y 7/2002
CN 2561975 Y 7/2003
(Continued)

OTHER PUBLICATIONS

Tamaoka et al., "Cooling Apparatus"; U.S. Appl. No. 14/483,843, filed Sep. 11, 2014.
(Continued)

*Primary Examiner* — Peter J Bertheaud
(74) *Attorney, Agent, or Firm* — Westerman, Hattori, Daniels & Adrian

(57) ABSTRACT

A cooling apparatus includes an impeller, a motor, a base portion, and a motor circuit board. The impeller includes a plurality of blades and a blade support portion. Of the plurality of blades, at least one pair of circumferentially adjacent blades are arranged to have a channel defined therebetween, the channel extending from axially upper edges to axially lower edges of the blades, and being arranged to be open toward the upper surface of the base portion. The base portion includes a heat source contact portion with which a heat source is to be in contact. At least one of the blades includes a blade edge opposed portion having an axially lower edge arranged opposite to the upper surface of the base portion. An outermost edge portion of the motor circuit board is arranged radially inward of a radially inner end portion of the blade edge opposed portion.

20 Claims, 10 Drawing Sheets

(51) Int. Cl.
*F04D 17/16* (2006.01)
*F04D 29/057* (2006.01)

(52) U.S. Cl.
CPC ..... *F04D 25/0693* (2013.01); *F04D 25/08* (2013.01); *F04D 29/057* (2013.01)

(58) Field of Classification Search
USPC ..... 417/420, 423.7, 423.14
See application file for complete search history.

(56) References Cited

U.S. PATENT DOCUMENTS

| | | | | |
|---|---|---|---|---|
| 7,038,913 | B2 * | 5/2006 | Lee | H01L 23/467 165/185 |
| 7,178,587 | B2 * | 2/2007 | Liu | H01L 23/467 165/121 |
| 7,869,212 | B2 * | 1/2011 | Kong | H01L 23/467 165/104.33 |
| 8,430,152 | B2 * | 4/2013 | Liu | H01L 23/4006 165/68 |
| 9,523,373 | B2 | 12/2016 | Tamaoka et al. | |
| 2002/0057022 | A1 | 5/2002 | Yamamoto | |
| 2004/0114327 | A1 | 6/2004 | Sri-Jayantha et al. | |
| 2005/0088817 | A1 | 4/2005 | Ou Yang et al. | |
| 2007/0030649 | A1 | 2/2007 | Tsai et al. | |
| 2007/0086168 | A1 | 4/2007 | Khanna et al. | |
| 2007/0257571 | A1 * | 11/2007 | Hong | F04D 29/056 310/67 R |
| 2008/0130226 | A1 | 6/2008 | Yamashita et al. | |
| 2008/0159853 | A1 | 7/2008 | Khanna et al. | |
| 2008/0180914 | A1 | 7/2008 | Khanna et al. | |
| 2008/0225488 | A1 | 9/2008 | Khanna et al. | |
| 2009/0174050 | A1 | 7/2009 | Bernstein et al. | |
| 2009/0199997 | A1 | 8/2009 | Koplow | |
| 2010/0177480 | A1 | 7/2010 | Koplow | |
| 2011/0103011 | A1 | 5/2011 | Koplow | |
| 2011/0123318 | A1 | 5/2011 | Khanna et al. | |
| 2012/0121407 | A1 * | 5/2012 | Yamashita | F04D 17/162 415/213.1 |
| 2012/0180992 | A1 | 7/2012 | Koplow | |
| 2013/0004114 | A1 | 1/2013 | Hasegawa et al. | |
| 2013/0064700 | A1 * | 3/2013 | Wu | F04D 17/16 417/423.7 |
| 2015/0110649 | A1 | 4/2015 | Tamaoka et al. | |
| 2016/0032929 | A1 | 2/2016 | Hasegawa et al. | |

FOREIGN PATENT DOCUMENTS

| | | | |
|---|---|---|---|
| CN | 2572065 | Y | 9/2003 |
| CN | 2616732 | Y | 5/2004 |
| CN | 101217859 | A | 7/2008 |
| CN | 102112939 | A | 6/2011 |
| CN | 102852850 | A | 1/2013 |
| CN | 204226234 | U | 3/2015 |
| EP | 0569738 | A1 | 11/1993 |
| EP | 2329337 | A1 | 6/2011 |
| JP | 2000-238089 | A | 9/2000 |
| JP | 2001-057493 | A | 2/2001 |
| JP | 2001-111277 | A | 4/2001 |
| JP | 2011-530191 | A | 12/2011 |
| WO | 2010/016963 | A1 | 2/2010 |

OTHER PUBLICATIONS

Tamaoka et al., "Fan", U.S. Appl. No. 14/499,680, filed Sep. 29, 2014.

Non-Final Office Action dated Jul. 28, 2017 issued in U.S. Appl. No. 15/283,807.

* cited by examiner

COOLING APPARATUS

BACKGROUND OF THE INVENTION

1. Field of the Invention

The present invention relates to a cooling apparatus.

2. Description of the Related Art

An electronic device, such as a notebook PC, produces a large amount of heat at a CPU and the like inside a case thereof. This makes it important to take measures against the heat. One common measure against the heat is to install a blower fan inside the case to discharge the heat. Meanwhile, when the blower fan is installed inside the case, the blower fan itself also absorbs the heat inside the case, and an operation environment of the blower fan may deteriorate.

Accordingly, a fan unit disclosed in JP-A 2004-316505 includes a heat dissipating layer arranged on an outside surface of an impeller, and a heat generated in a rotating shaft is dissipated therethrough.

Here, in a common centrifugal fan, an air current is directed from one axial side (an inlet side) to a radially outer side (an outlet side) by circumferential rotation of blades. At this time, an air between adjacent ones of the blades is directed radially from the one axial side by the rotation of the blades, and the air is therefore unlikely to flow to an opposite axial side. This makes it difficult for a heat on the opposite axial side inside the case to be discharged, and the heat may stay inside the centrifugal fan.

SUMMARY OF THE INVENTION

A cooling apparatus according to a preferred embodiment of the present invention includes an impeller, a motor, a base portion, and a motor circuit board. The impeller is arranged to rotate about a central axis extending in a vertical direction, and includes a plurality of blades arranged in a circumferential direction and a blade support portion arranged to support the plurality of blades. The motor is arranged to rotate the impeller. The base portion is arranged to support the motor. The motor circuit board is arranged on an upper surface of the base portion to supply a drive current to coils of the motor. Of the plurality of blades, at least one pair of circumferentially adjacent blades are arranged to have a channel defined therebetween, the channel extending from axially upper edges to axially lower edges of the blades, and being arranged to be open toward the upper surface of the base portion. The base portion includes, in a lower surface thereof, a heat source contact portion with which a heat source is to be in contact. At least one of the blades includes a blade edge opposed portion having an axially lower edge arranged opposite to the upper surface of the base portion. An outermost edge portion of the motor circuit board is arranged radially inward of a radially inner end portion of the blade edge opposed portion.

According to the above preferred embodiment of the present invention, an improvement in performance of the cooling apparatus is achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
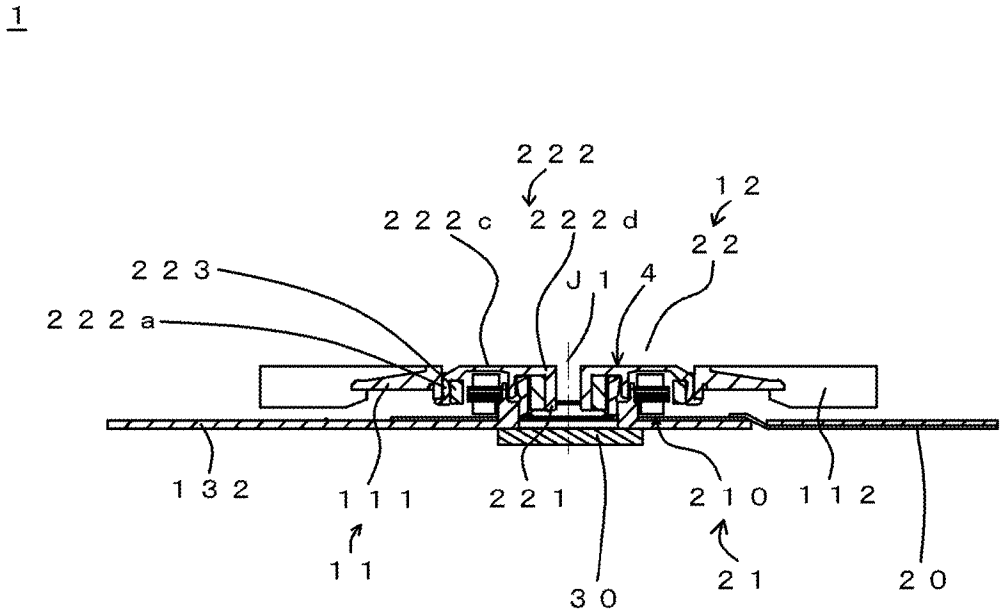
FIG. 1 is a cross-sectional view of a cooling apparatus 1 according to a first preferred embodiment of the present invention.

It is assumed herein that a vertical direction is defined as a direction in which a central axis of a motor extends, and that an upper side and a lower side along the central axis in FIG. 1 are referred to simply as an upper side and a lower side, respectively. It should be noted, however, that the above definitions of the vertical direction and the upper and lower sides should not be construed to restrict relative positions or directions of different members or portions when the motor is actually installed in a device. Also note that a direction parallel to the central axis is referred to by the term "axial direction", "axial", or "axially", that radial directions centered on the central axis are simply referred to by the term "radial direction", "radial", or "radially", and that a circumferential direction about the central axis is simply referred to by the term "circumferential direction", "circumferential", or "circumferentially".

FIG. 1 is a cross-sectional view of a cooling apparatus (i.e., a blower fan) 1 according to a first preferred embodiment of the present invention. The cooling apparatus 1 is a centrifugal fan, and is used, for example, to cool electronic components inside a notebook personal computer. The cooling apparatus 1 includes an impeller 11, a motor 12, a base portion 132, and a motor circuit board 14. The impeller 11 is caused by the motor 12 to rotate about a central axis J1 extending in a vertical direction. The impeller 11 includes a plurality of blades 112 arranged in a circumferential direction, and a blade support portion 111 arranged to support the blades 112. The motor circuit board 14 is arranged on an upper surface of the base portion 132 to supply a drive current to a plurality of coils 212 of the motor 12.

In the cooling apparatus 1, the motor 12 causes the impeller 11 to rotate about the central axis J1 to produce an air current.

The impeller 11 is made of a resin having high thermal conductivity (hereinafter referred to as a heat conductive resin), and includes the blade support portion 111, which is substantially cylindrical, and the plurality of blades 112. An inner circumferential surface of the blade support portion 111 is fixed to a rotating portion 22 of the motor 12. The blades 112 are arranged to extend radially outward from an outer circumferential surface of the blade support portion 111 with the central axis J1 as a center. The blade support portion 111 and the plurality of blades 112 are defined as a single continuous member by a resin injection molding process. Note that the impeller 11 may be made of aluminum. A heat from a heat source 30, which will be described below, is transferred to the impeller 11 through the motor 12, and is dissipated through rotation of the impeller 11. In the case where the impeller 11 is made of the resin, the impeller 11 is capable of rotating at a higher speed, since the resin has a specific gravity smaller than that of aluminum. Air volume is thereby increased, and an improvement in cooling performance is achieved. The heat conductive resin is preferably a resin including a metal filler, and an improvement in the cooling performance can thereby be achieved. Note that the impeller 11 is preferably arranged to have a thermal conductivity of 1.0 W/(m·K) or more. More preferably, the impeller 11 is arranged to have a thermal conductivity of 3.0 W/(m·K) or more.

Of the plurality of blades 112, at least one pair of circumferentially adjacent blades 112 are arranged to have a channel defined therebetween, the channel extending from axially upper edges to axially lower edges of the blades 112. The channel is arranged to be open toward the upper surface of the base portion 132. At least one of the blades 112 includes a blade edge opposed portion 112*a* having an axially lower edge arranged opposite to the upper surface of the base portion 132.

The base portion 132 is a substantially plate-shaped member produced by subjecting a metal sheet to press working. The base portion 132 defines a portion of a stationary portion 21 of the motor 12. The base portion 132 is arranged below the motor 12 and the impeller 11 to support the motor 12. Note that the base portion 132 may be made of aluminum or a heat conductive resin. In this case, the heat can be dissipated through the base portion 132 through the rotation of the impeller 11. Note that a material of the base portion 132 may be copper, an aluminum alloy, iron, or an iron-base alloy (including SUS). An air sucked from above the motor 12 and the impeller 11 is discharged radially outward through the rotation of the impeller 11. That is, a radially outer end of the base portion 132 defines an air outlet extending over an entire circumference of the base portion 132. Note that, although the air outlet is arranged to extend over the entire circumference of the base portion 132 according to the present preferred embodiment, the air outlet may be arranged to extend over only a portion of the circumference of the base portion 132 while a side wall portion arranged to cover a lateral side of the impeller 11 is provided.

The base portion 132 includes, in a lower surface thereof, a heat source contact portion 10 with which the heat source 30 is to be in contact. The heat source 30 is a CPU or another electronic component which is another heat-radiating component. According to the present preferred embodiment, an upper surface of the heat source 30 is arranged to be in thermal connection with the lower surface of the base portion 132. The heat source 30 and the base portion 132 are arranged to be in close contact with each other with a heat-conducting member, such as grease or a thermal sheet which is a portion of the heat source 30, arranged therebetween, and this heat-conducting member causes the heat source 30 and the lower surface of the base portion 132 to be in thermal connection with each other. The heat source 30 is preferably arranged in a region overlapping with a bearing portion 23 in a plan view. A heat which has been transferred from the heat source 30 to the base portion 132 is transferred to the bearing portion 23, and is also easily transferred to a region of the base portion 132 which is under the blades 112 and where forced cooling is most effective within the base portion 132, which will be described below. This leads to an improvement in heat dissipation performance.

Figure 2:
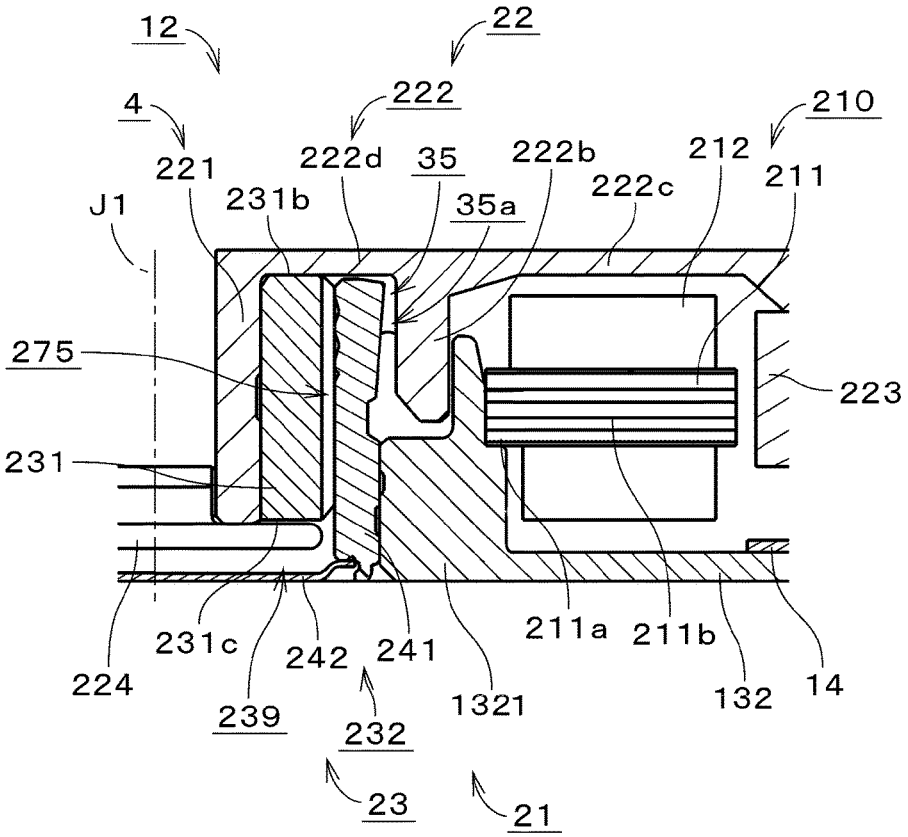
FIG. 2 is a cross-sectional view of a motor 12 and its vicinity according to the first preferred embodiment.

FIG. 2 is a cross-sectional view of the motor 12 and its vicinity. The motor 12 is an outer-rotor motor. The motor 12 includes the stationary portion 21 and the rotating portion 22. The stationary portion 21 includes the bearing portion 23, the base portion 132, a stator 210, and the motor circuit board 14.

The bearing portion 23 is arranged radially inward of the stator 210. The bearing portion 23 includes a sleeve 231 and a bearing housing 232. The sleeve 231 is substantially cylindrical in shape and centered on the central axis J1. The sleeve 231 is a metallic sintered body. The sleeve 231 is impregnated with a lubricating oil. A plurality of circulation grooves 275, each of which is arranged to extend in an axial direction and is used for pressure regulation, are defined in an outer circumferential surface of the sleeve 231. The plurality of circulation grooves 275 are arranged at regular intervals in a circumferential direction. The bearing housing 232 is arranged substantially in the shape of a cylinder with a bottom, and includes a housing cylindrical portion 241 and a cap 242. The housing cylindrical portion 241 is substantially cylindrical in shape and centered on the central axis J1, and is arranged to cover the outer circumferential surface of the sleeve 231. The sleeve 231 is fixed to an inner circumferential surface of the housing cylindrical portion 241 through an adhesive. The bearing housing 232 is made of a metal. The cap 242 is fixed to a lower end portion of the housing cylindrical portion 241. The cap 242 is arranged to close a bottom portion of the housing cylindrical portion 241. Note that use of the adhesive to fix the sleeve 231 to the inner circumferential surface of the housing cylindrical portion 241 is not essential to the present invention. For example, the sleeve 231 may be fixed to the inner circumferential surface of the housing cylindrical portion 241 through press fit.

The base portion 132 includes a rising portion 1321 in a radially inner portion thereof. The rising portion 1321 is a substantially annular portion. An inner circumferential surface of the rising portion 1321 is fixed to a lower region of an outer circumferential surface of the housing cylindrical portion 241, i.e., a lower region of an outer circumferential surface of the bearing housing 232, through adhesion or press fit. Note that both adhesion and press fit may be used for this fixing.

The stator 210 is a substantially annular member centered on the central axis J1. The stator 210 includes a stator core 211 and the plurality of coils 212 arranged on the stator core 211. The stator core 211 is defined by laminated silicon steel sheets, each of which is in the shape of a thin sheet. The stator core 211 includes a substantially annular core back 211*a* and a plurality of teeth 211*b* arranged to project radially outward from the core back 211*a*. A conducting wire is wound around each of the plurality of teeth 211*b* to define the plurality of coils 212. The motor circuit board 14 is arranged below the stator 210. Lead wires of the coils 212 are electrically connected to the motor circuit board 14.

The rotating portion 22 includes a shaft 221, a thrust plate 224, a rotor holder 222, and a rotor magnet 223. The shaft 221 is arranged to have the central axis J1 as a center thereof.

Referring to FIG. 1, the rotor holder 222 is arranged substantially in the shape of a covered cylinder and centered on the central axis J1. The rotor holder 222 includes a tubular "cylindrical magnet holding portion" 222*a*, a cover portion 222*c*, and a first thrust portion 222*d*. The cylindrical magnet holding portion 222*a*, the cover portion 222*c*, and the first thrust portion 222*d* are defined integrally with one another. The first thrust portion 222*d* is arranged to extend radially outward from an upper end portion of the shaft 221. The cover portion 222*c* is arranged to extend radially outward from the first thrust portion 222*d*. A lower surface of the cover portion 222*c* is a substantially annular surface arranged around the shaft 221. Referring to FIG. 2, the first thrust portion 222*d* is arranged axially opposite each of an upper surface 231*b* of the sleeve 231 and an upper surface of the housing cylindrical portion 241.

The thrust plate 224 includes a substantially disk-shaped portion arranged to extend radially outward. The thrust plate 224 is fixed to a lower end portion of the shaft 221, and is arranged to extend radially outward from the lower end portion thereof. The thrust plate 224 is accommodated in a plate accommodating portion 239 defined by a lower surface 231*c* of the sleeve 231, an upper surface of the cap 242, and a lower portion of the inner circumferential surface of the housing cylindrical portion 241. An upper surface of the thrust plate 224 is a substantially annular surface arranged around the shaft 221. The upper surface of the thrust plate 224 is arranged axially opposite the lower surface 231*c* of the sleeve 231, i.e., a downward facing surface in the plate accommodating portion 239. Hereinafter, the thrust plate 224 will be referred to as a "second thrust portion 224". A lower surface of the second thrust portion 224 is arranged opposite to the upper surface of the cap 242 of the bearing housing 232. The shaft 221 is inserted in the sleeve 231. Note that the thrust plate 224 may be defined integrally with the shaft 221.

The shaft 221 is defined integrally with the rotor holder 222. The shaft 221 and the rotor holder 222 are produced by subjecting a metallic member to a cutting process. That is, the cover portion 222*c* and the shaft 221 are continuous with each other. Note that the shaft 221 may be defined by a member separate from the rotor holder 222. In this case, the upper end portion of the shaft 221 is fixed to the cover portion 222*c* of the rotor holder 222. Referring to FIG. 1, the rotor magnet 223 is fixed to an inner circumferential surface of the cylindrical magnet holding portion 222*a*, which is arranged to extend axially downward from a radially outer end portion of the cover portion 222*c* of the rotor holder 222.

Referring to FIG. 2, the rotor holder 222 further includes a substantially annular "annular tubular portion" 222*b* arranged to extend downward from an outer edge portion of the first thrust portion 222*d*. The annular tubular portion 222*b* will be hereinafter referred to as a "rotor cylindrical portion 222*b*". The rotor cylindrical portion 222*b* of the rotor holder 222 is arranged radially inward of the stator 210. The rotor cylindrical portion 222*b* is arranged radially outward of the bearing housing 232. An inner circumferential surface of the rotor cylindrical portion 222*b* is arranged radially opposite an outer circumferential surface of an upper portion of the housing cylindrical portion 241. A seal gap 35 is defined between the inner circumferential surface of the rotor cylindrical portion 222*b* and the outer circumferential surface of the housing cylindrical portion 241. A seal portion 35*a* having a surface of the lubricating oil defined therein is defined in the seal gap 35.

Referring to FIG. 1, the inner circumferential surface of the blade support portion 111 is fixed to an outer circumferential surface of the cylindrical magnet holding portion 222*a* of the rotor holder 222. The plurality of blades 112 are arranged outside the outer circumferential surface of the cylindrical magnet holding portion 222*a*. The upper end portion of the shaft 221 is fixed to the impeller 11 through the rotor holder 222. Note that the impeller 11 may be defined integrally with the rotor holder 222. In this case, the upper end portion of the shaft 221 is fixed to the impeller 11 in a direct manner.

The rotor magnet 223 is substantially cylindrical in shape and centered on the central axis J1. As described above, the rotor magnet 223 is fixed to the inner circumferential surface of the cylindrical magnet holding portion 222*a*. The rotor magnet 223 is arranged radially outward of the stator 210.

Figure 3:
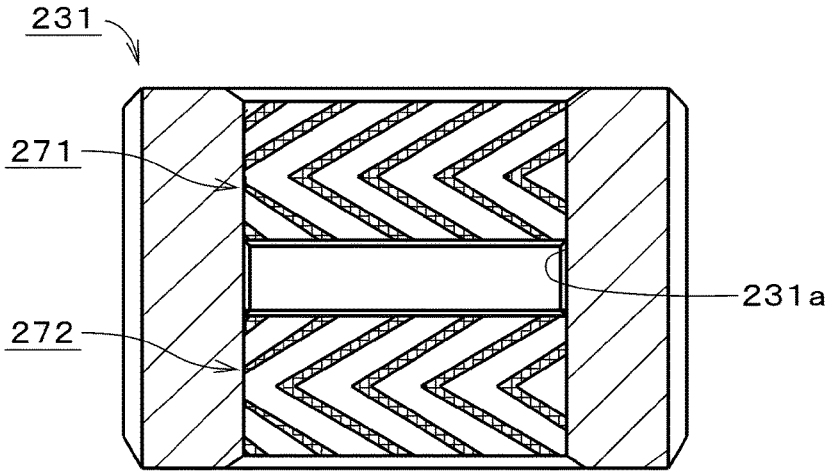
FIG. 3 is a cross-sectional view of a sleeve 231 according to the first preferred embodiment.
Figure 4:
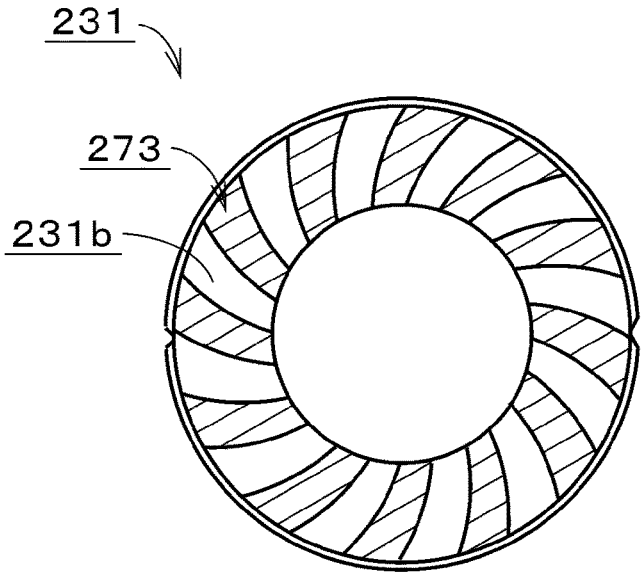
FIG. 4 is a plan view of the sleeve 231.
Figure 5:
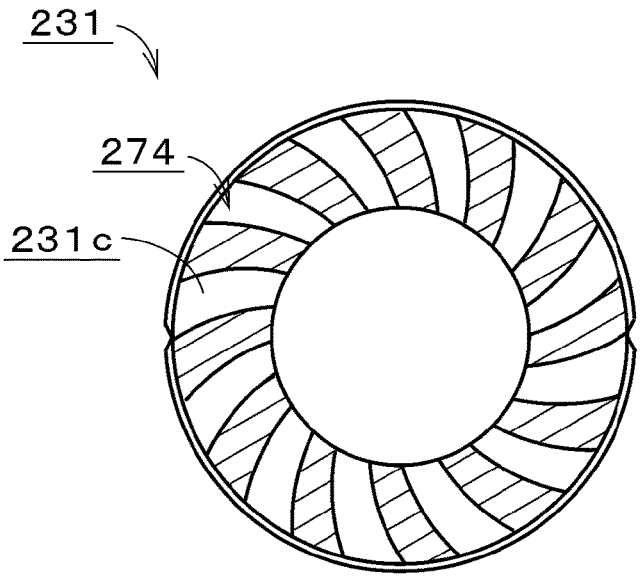
FIG. 5 is a bottom view of the sleeve 231.

FIG. 3 is a cross-sectional view of the sleeve 231. A first radial dynamic pressure groove array 271 and a second radial dynamic pressure groove array 272, each of which is made up of a plurality of grooves arranged in a herringbone pattern, are defined in an upper portion and a lower portion, respectively, of an inner circumferential surface 231*a* of the sleeve 231. FIG. 4 is a plan view of the sleeve 231. A first thrust dynamic pressure groove array 273, which is made up of a plurality of grooves arranged in a spiral pattern, is defined in the upper surface 231*b* of the sleeve 231. FIG. 5 is a bottom view of the sleeve 231. A second thrust dynamic pressure groove array 274, which is made up of a plurality of grooves arranged in the spiral pattern, is defined in the lower surface 231*c* of the sleeve 231.

Figure 6:
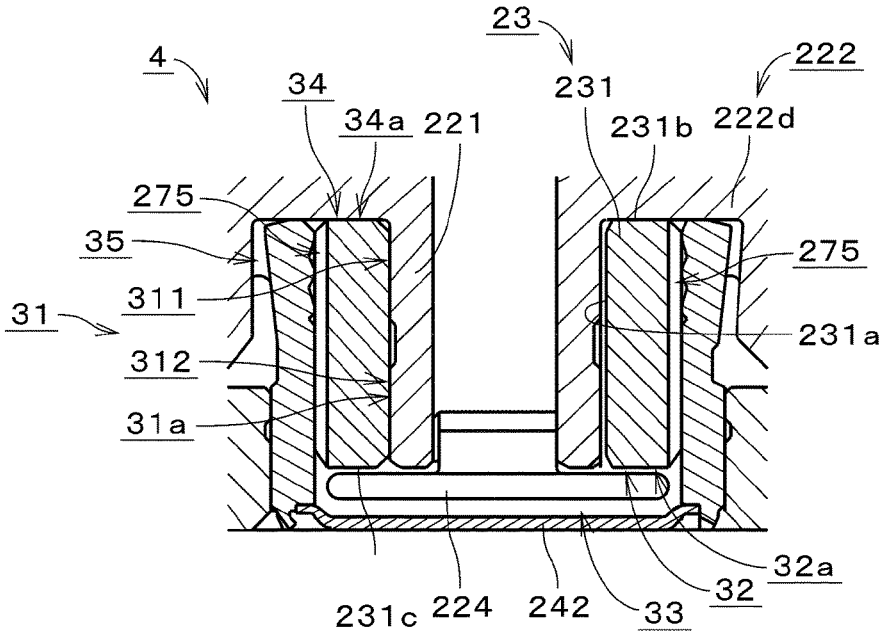
FIG. 6 is a cross-sectional view of a bearing portion 23 and its vicinity according to the first preferred embodiment.

FIG. 6 is a cross-sectional view of the bearing portion 23 and its vicinity. A radial gap 31 is defined between an outer circumferential surface of the shaft 221 and the inner circumferential surface 231*a* of the sleeve 231. The radial gap 31 includes a first radial gap 311 and a second radial gap 312, which is arranged on a lower side of the first radial gap 311. The first radial gap 311 is defined between the outer circumferential surface of the shaft 221 and a portion of the inner circumferential surface 231*a* of the sleeve 231 in which the first radial dynamic pressure groove array 271 illustrated in FIG. 3 is defined. The lubricating oil is arranged in the first radial gap 311. The second radial gap 312 is defined between the outer circumferential surface of the shaft 221 and a portion of the inner circumferential surface 231*a* of the sleeve 231 in which the second radial dynamic pressure groove array 272 illustrated in FIG. 3 is defined. The lubricating oil is arranged in the second radial gap 312. The first radial gap 311 and the second radial gap 312 are arranged to together define a radial dynamic pressure bearing portion 31*a* arranged to produce a fluid dynamic pressure in the lubricating oil. The shaft 221 is supported in a radial direction by the radial dynamic pressure bearing portion 31*a*.

A first thrust gap 34 is defined between a portion of the upper surface 231*b* of the sleeve 231 in which the first thrust dynamic pressure groove array 273 is defined and a lower surface of the first thrust portion 222*d*, i.e., an upper thrust portion. The lubricating oil is arranged in the first thrust gap 34. The first thrust gap 34 is arranged to define an upper thrust dynamic pressure bearing portion 34*a* arranged to produce a fluid dynamic pressure in the lubricating oil. The first thrust portion 222*d* is supported in the axial direction by the upper thrust dynamic pressure bearing portion 34*a*.

A second thrust gap 32 is defined between a portion of the lower surface 231*c* of the sleeve 231 in which the second thrust dynamic pressure groove array 274 is defined and the upper surface of the second thrust portion 224, i.e., a lower thrust portion. The lubricating oil is arranged in the second thrust gap 32. The second thrust gap 32 is arranged to define a lower thrust dynamic pressure bearing portion 32*a* arranged to produce a fluid dynamic pressure in the lubricating oil. The second thrust portion 224 is supported in the axial direction by the lower thrust dynamic pressure bearing portion 32*a*. The upper thrust dynamic pressure bearing portion 34*a* and the lower thrust dynamic pressure bearing portion 32*a* are arranged to be in communication with each other through the circulation grooves 275.

A third thrust gap 33 is defined between the upper surface of the cap 242 of the bearing housing 232 and the lower surface of the second thrust portion 224.

In the motor 12, the seal gap 35, the first thrust gap 34, the radial gap 31, the second thrust gap 32, and the third thrust gap 33 are arranged to together define a single continuous bladder structure, and the lubricating oil is arranged continuously in this bladder structure. Within the bladder structure, a surface of the lubricating oil is defined only in the seal gap 35.

Referring to FIG. 2, in the motor 12, the shaft 221, the first thrust portion 222*d*, the rotor cylindrical portion 222*b*, which is arranged to extend downward from the outer edge portion of the first thrust portion 222*d*, the second thrust portion 224, the bearing portion 23, the rising portion 1321, and the lubricating oil are arranged to together define a bearing mechanism 4, which is a bearing apparatus. Hereinafter, each of the shaft 221, the first thrust portion 222*d*, the rotor cylindrical portion 222*b*, the second thrust portion 224, the bearing portion 23, and the rising portion 1321 will be referred to as a portion of the bearing mechanism 4. In the bearing mechanism 4, the shaft 221, the first thrust portion 222*d*, and the second thrust portion 224 are arranged to rotate relative to the bearing portion 23 with the lubricating oil intervening therebetween.

In the motor 12, once power is supplied to the stator 210, a torque centered on the central axis J1 is produced between the rotor magnet 223 and the stator 210. The rotating portion 22 and the impeller 11 are supported through the bearing mechanism 4 such that the rotating portion 22 and the impeller 11 are rotatable about the central axis J1 with respect to the stationary portion 21. The air is sucked from above the motor 12 and the impeller 11, and is sent out through the air outlet through the rotation of the impeller 11.

Figure 7:
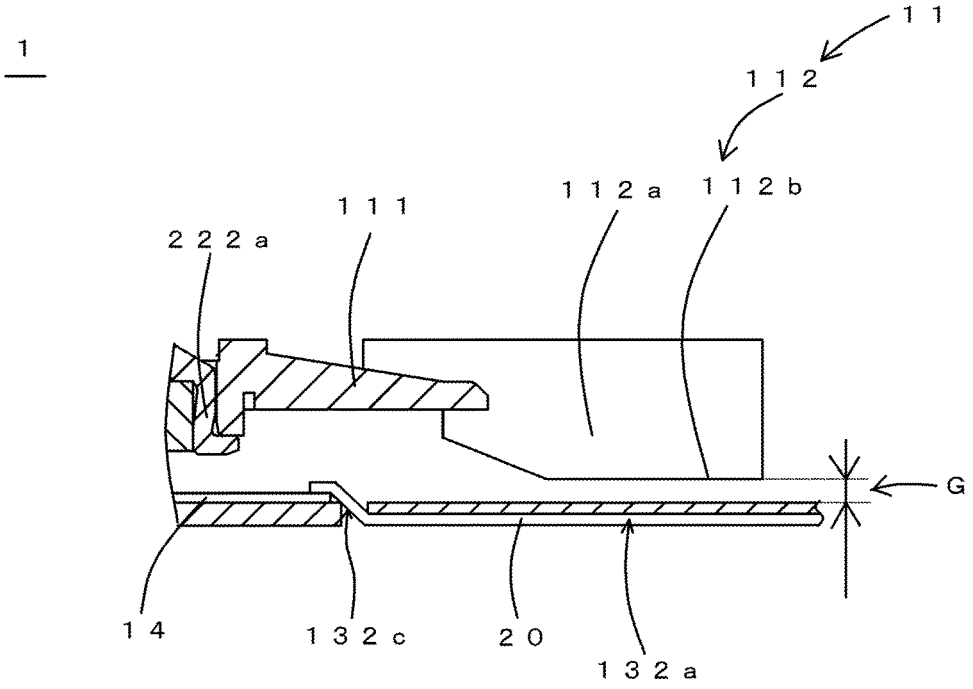
FIG. 7 is a cross-sectional view of a portion of the cooling apparatus 1, illustrating one of a plurality of blades 112 and its vicinity.

FIG. 7 is a cross-sectional view of a portion of the cooling apparatus 1, illustrating one of the plurality of blades 112 and its vicinity. The impeller 11 is held on an outside surface of the cylindrical magnet holding portion 222*a* of the rotor holder 222. In more detail, the inner circumferential surface of the blade support portion 111 is adhered and fixed to the outside surface of the cylindrical magnet holding portion 222*a* with a lower end of the blade support portion 111 being arranged to be in contact with an upper surface of a flange portion at a lower end of the cylindrical magnet holding portion 222*a*. The plurality of blades 112 are arranged in the circumferential direction outside the blade support portion 111. An axially lower edge of each of the plurality of blades 112 includes the blade edge opposed portion 112*a*, which is arranged to extend from a vicinity of an outer end of the blade support portion 111, and which is arranged opposite to the upper surface of the base portion 132. In addition, the blade edge opposed portion 112*a* is positioned radially outward of and axially below the lower end of the blade support portion 111. The blade edge opposed portion 112*a* includes a closely opposed portion 112*b* where the distance between the axially lower edge thereof and the upper surface of the base portion 132 is very short, the closely opposed portion 112*b* extending over a quarter or more of the total length of the blade edge opposed portion 112*a*. The distance G between an axially lower edge of the closely opposed portion 112*b* and the upper surface of the base portion 132 is preferably arranged to be 800 μm or less.

Figure 8:
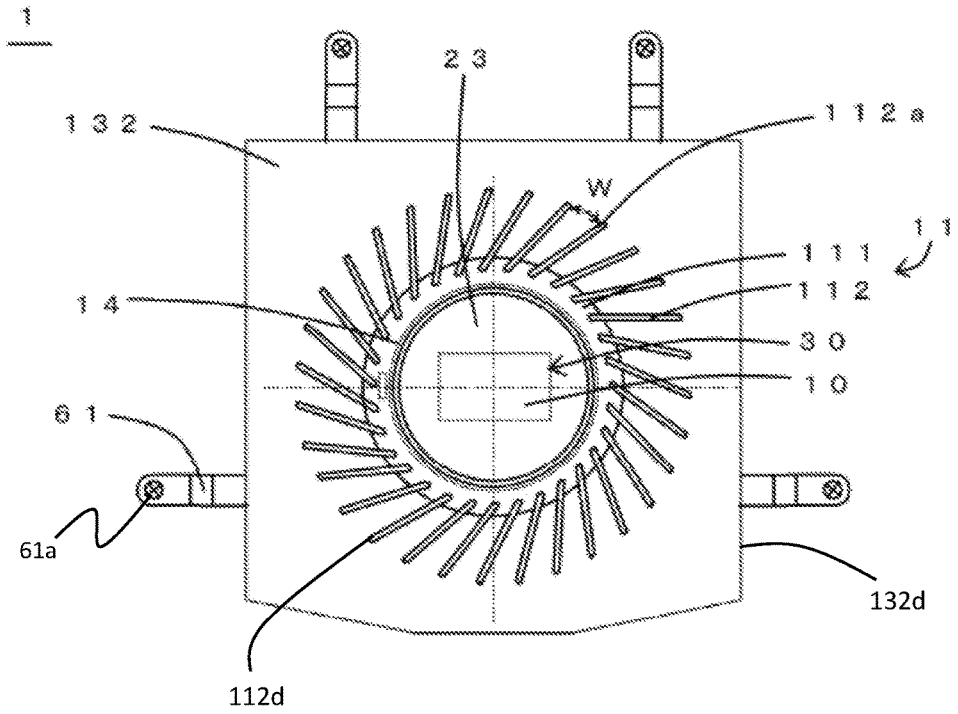
FIG. 8 is a top view of the cooling apparatus 1.

FIG. 8 is a top view of the cooling apparatus 1. Each of the plurality of blades 112 is arranged to extend radially outward from the blade support portion 111 to assume a straight line. The circumferential thickness of each blade 112 is arranged to be substantially uniform from a radially inner end to a radially outer end of the blade 112. The base portion 132 includes elastic portions 61 each of which is arranged to extend axially upward on a radially outer side of the plurality of blades 112. A top of each elastic portion 61 includes a fixing member insertion hole 61*a* arranged to pass therethrough in the vertical direction. Accordingly, there is a need to reduce thermal resistance against heat transfer from the heat source 30 to the base portion 132. According to the above structure, a screw is inserted into each fixing member insertion hole, and each elastic portion 61 is fixed while being pressed axially downward. This makes it possible to secure a sufficient area of contact between the heat source 30 and the base portion 132 and a sufficient contact pressure to achieve a reduction in the thermal resistance. Here, the number of elastic portions 61 is three or more, and the central axis J1 is positioned in an area surrounded by a line joining centers of the plurality of fixing member insertion holes. Therefore, the above structure makes it possible to fix the base portion 132 while pressing the base portion 132 in a region radially close to the central axis J1. This makes it possible to secure a sufficient area of contact between the heat source 30 and the base portion 132 and a sufficient contact pressure to achieve a reduction in the thermal resistance. Each elastic portion 61 is defined integrally with the base portion 132. A reduction in the number of steps of a process of assembling parts of the cooling apparatus 1 is thereby achieved. The outward end 112*d* of each of the blades 112 is inside the contour 132*d* of the base portion 132 in a plan view seen from a portion extended along the vertical direction.

The heat source contact portion 10 is arranged radially inward of an outer end of the impeller 11 in a plan view. Overlapping of the blades 112 and the heat source 30 in the plan view enables an air current passing between the blades 112 to pass the heat source contact portion 10 on the base portion 132. That is, the heat is transferred from the heat source 30 to the base portion 132, and is directly exposed to the air current. Accordingly, the heat which has been transferred from the heat source 30 to the base portion 132 is effectively discharged through the air outlet by the air current which has passed between the blades 112. According to the present preferred embodiment, the bearing portion 23 and the heat source contact portion 10 are arranged to axially overlap with each other. In this case, a heat is transferred from the heat source 30 to the bearing portion 23, and is dissipated through the impeller 11. That is, the heat source 30 is preferably arranged such that the heat is not only efficiently transferred from the heat source 30 radially outward through the base portion 132, but is also transferred to the bearing portion 23.

Referring to FIG. 1, the motor circuit board 14 is arranged to extend over an entire circumferential extent on the upper surface of the base portion 132. The motor circuit board 14 is arranged radially outward of the outer circumferential surface of the bearing housing 232 and below the stator 210. In more detail, the motor circuit board 14 is arranged radially outward of a region where the rising portion 1321, to which the outer circumferential surface of the bearing housing 232 is fixed, and an inner circumferential surface of the stator 210 are fixed to each other. The motor circuit board 14 is electrically connected to a conducting wire 20. The conducting wire 20 will be described below.

Referring to FIG. 7, an outermost edge portion of the motor circuit board 14 is arranged radially inward of a radially inner end portion of the blade edge opposed portion 112*a*.

The blade edge opposed portion 112*a* is a portion arranged to approach the upper surface of the base portion 132. In general, each blade 112 of the impeller 11 may become deformed axially upward and downward due to a thermal contraction characteristic of a material thereof or the like when the impeller 11 is molded. Therefore, it is necessary to provide a certain clearance space between the blade edge opposed portion 112*a* and the base portion 132 in order to prevent the impeller 11 from making contact with the base portion 132 during the rotation of the impeller 11 even if the impeller 11 has experienced a deformation. Meanwhile, in the case where the motor circuit board 14 has a large outside diameter, the motor circuit board 14 may axially overlap with the blade edge opposed portion 112*a*. In this case, it is necessary to provide a certain clearance space between the blade edge opposed portion 112*a* and the motor circuit board 14 in order to prevent the impeller 11 from making contact with the motor circuit board 14. A heat dissipation characteristic of the base portion 132 is improved as the axial distance between the blade edge opposed portion 112*a* and the base portion 132 decreases (a detailed description thereof will be provided below). That is, it is possible to reduce the distance between the blade edge opposed portion 112*a* and the base portion 132 by arranging the blade edge opposed portion 112*a* and the motor circuit board 14 not to axially overlap with each other.

The blade edge opposed portion 112*a* includes the closely opposed portion 112*b*, where the distance G between the axially lower edge thereof and the upper surface of the base portion 132 is 800 μm or less, the closely opposed portion 112*b* extending over the quarter or more of the total length of the blade edge opposed portion 112*a*. In addition, the axial distance G between a lowermost end of the blade 112 and the upper surface of the base portion 132 axially opposed thereto is 800 μm or less. This enables the air passing between the blades 112 to impinge on the base portion 132 to make it easier for the heat transferred to the base portion 132 to be dissipated. In addition, when the distance G between the axially lower edge of the blade 112 and the upper surface of the base portion 132 is 800 μm or less, an air existing in a space therebetween is prone to be dominated by viscosity, and the air is easily moved by rotation of the blades 112. In other words, an air on the upper surface of the base portion 132 is easily moved, an improvement in the heat dissipation characteristic of the base portion 132 is easily achieved, and performance of the cooling apparatus 1 is improved.

The outermost edge portion of the motor circuit board 14 is arranged radially inward of the outer end of the blade support portion 111. An axial space between the blade support portion 111 and the base portion 132 is a space which does not easily experience a direct effect of the air current passing between the blades 112. Therefore, forced cooling due to the air current does not easily occur at this space. That is, arrangement of the motor circuit board 14 in this space contributes to preventing the motor circuit board 14 from interfering with forced cooling of the base portion 132 by the air current.

The lower end of the blade support portion 111 is arranged at a level higher than that of the lowermost end of the blade 112. Thus, a space in which the motor circuit board 14 is arranged can be secured under the blade support portion 111. This makes it possible to arrange the lowermost end of the blade 112 still closer to the base portion 132, improving efficiency in the forced cooling of the base portion 132.

According to the present preferred embodiment, a heat inside a case which originates from the heat-radiating component is transferred from the base portion 132 to the impeller 11 through the motor 12. Here, a further improvement in the cooling performance can be achieved by arranging the impeller 11 to be made of a material having high thermal conductivity or a material having an excellent heat dissipation characteristic. In addition, when the closely opposed portion 112*b* is included in the blade edge opposed portion 112*a*, and the distance G between the axially lower edge of the closely opposed portion 112*b* and the upper surface of the base portion 132 is 800 μm or less, the air sucked from above the motor 12 and the impeller 11 passes between the blades 112 of the impeller 11 to impinge on the base portion 132. Thus, a wind strikes the base portion 132 to achieve an improvement in the cooling performance.

According to the present preferred embodiment, the plurality of blades 112 include one or more blades 112 in each of which the closely opposed portion 112*b* is arranged to cover a half or more of an entire region radially outside a radial middle of the blade edge opposed portion 112*a*. Accordingly, when the blade edge opposed portion 112*a* is arranged radially outward, the blade 112 is able to do work in a region where the circumferential velocity is high, and the air is easily discharged radially outward. In addition, because the circumferential velocity of the blade edge opposed portion 112*a* is high, an air existing between the blade edge opposed portion 112*a* and the upper surface of the base portion 132 is easily discharged radially outward. Thus, an improvement in dissipation of heat from the base portion 132 is achieved as the air staying on the upper surface of the base portion 132 is thus moved.

According to the present preferred embodiment, the plurality of blades 112 include one or more blades 112 regarding each of which the distance between the axially lower edge of the blade 112 and the upper surface of the base portion 132 is arranged to be 800 μm or more in a region over which a portion of the blade edge opposed portion 112*a* which is radially inside the closely opposed portion 112*b* extends. Accordingly, a main flow velocity component of an air current generated by the rotation of the plurality of blades 112 is directed axially downward. Thus, an air impinges on the base portion 132, and is discharged radially outward by action of the blades 112. The volume of air which is discharged radially outward through radially outer ends of the blades 112 gradually decreases with increasing height. When the present structure is adopted, in a region where radially inner portions of the blades 112 are arranged, action of discharging an air radially outward as caused by the rotation of the blades 112 is weak, and an axial flow velocity component is accordingly large. That is, the air once stays under the region where the radially inner portions of the blades 112 are arranged. The air is thereafter discharged radially outward by the rotating action of the blades 112. Accordingly, the volume of air which is discharged radially outward through the radially outer ends of the blades 112 is increased in a lower region. In other words, the amount of air which passes the upper surface of the base portion 132 is increased. As a result, an improvement in the cooling performance is achieved.

It is assumed that W (m) denotes a maximum circumferential width of the channel defined between the pair of blades 112, that G (m) denotes an average width of a gap between the upper surface of the base portion 132 and the closely opposed portion 112*b* of the at least one blade 112 adjacent to the channel, that S (m/sec) denotes a circumferential rotation speed of a portion of the blade 112 at which the channel has the maximum circumferential width, and that v ($m^2$/sec) denotes the kinematic viscosity of a gas which surrounds the cooling apparatus 1. In this case, according to the present preferred embodiment, $G \times S/v$ is preferably arranged to be less than 500, and $G \times W/v$ is preferably arranged to be 1000 or more. The above arrangements make the distance between the lower edge of the blade 112 and the upper surface of the base portion 132 sufficiently short, reducing the Reynolds number. An air current near the lower edge of the blade 112 becomes prone to be dominated by viscosity, and an effect of forcibly taking off an air near the upper surface of the base portion 132 through a viscous force is obtained. A channel which has a sufficient width is arranged in the close vicinity of the lower edge of the blade 112, and as the Reynolds number at this channel indicates a turbulence-dominant condition, the air taken off is effectively dispersed through this channel. Owing to the two effects described above, the air staying near the surface of the base portion 132 can be effectively removed, and therefore, high cooling performance is realized.

Referring to FIG. 7, the motor 12 includes the conducting wire 20, which is electrically connected to an outside. One end of the conducting wire 20 is electrically connected to the motor circuit board 14, while an opposite end of the conducting wire 20 is electrically connected to the outside. The base portion 132 includes a conducting wire insertion hole 132*c* arranged to pass therethrough in the vertical direction, and a conducting wire guide portion 132*a* arranged to pass radially from the conducting wire insertion hole 132*c* up to an outer circumferential end of the base portion 132. The conducting wire 20 is arranged to pass through the conducting wire insertion hole 132*c*, and is drawn out to an outside through the conducting wire guide portion 132*a*. Regarding the cooling apparatus 1, there is a need to reduce the thermal resistance against the heat transfer from the heat source 30 to the base portion 132. Accordingly, it is necessary to avoid intervention of the conducting wire 20 between the base portion 132 and the heat source 30. Adoption of the above-described structure makes it possible to avoid the intervention of the conducting wire 20 between the base portion 132 and the heat source 30, and thereby to reduce the thermal resistance. In this case, a sufficient area of contact between the heat source 30 and the base portion 132 and a sufficient contact pressure can be secured to reduce the thermal resistance. According to the present preferred embodiment, the conducting wire 20 is a flexible printed circuit (FPC). The FPC is fixed to the base portion 132 through an adhesive.

According to the present preferred embodiment, the conducting wire guide portion 132*a* is preferably a groove defined in the lower surface of the base portion 132, the conducting wire guide portion 132*a* is preferably arranged to have a radial extent greater than a circumferential width thereof, and the conducting wire guide portion 132*a* is preferably arranged to have a depth greater than an axial thickness of the conducting wire 20. This enables the conducting wire 20 to be accommodated between the heat source 30 and the base portion 132, and makes it possible to prevent the conducting wire 20 from playing. Moreover, a break in the conducting wire 20 due to the heat can be prevented. Furthermore, a contact of the conducting wire 20 with the impeller 11 can be prevented. This makes it possible to reduce the distance between the axially lower edge of the blade 112 and the upper surface of the base portion 132. That is, an improvement in the cooling performance can be achieved. Note that the base portion 132 is preferably arranged to have a thickness greater than the axial thickness of the conducting wire 20.

The bearing mechanism 4 according to the present preferred embodiment, which is arranged to rotate the motor 2, is a fluid dynamic bearing. In more detail, the bearing mechanism 4 includes a stationary bearing surface (not shown) defined by the bearing portion 23, and a rotating bearing surface (not shown) defined by a combination of the shaft 221, the first thrust portion 222*d*, and the second thrust portion 224 of the rotating portion 22. The rotating bearing surface is opposed to the stationary bearing surface with a bearing gap intervening therebetween. The bearing gap is filled with the lubricating oil. Since the bearing mechanism 4 is such a fluid dynamic bearing, the bearing mechanism 4 can have a small axial dimension and still permit little run-out, and therefore, the distance between the axially lower edge of the blade 112 and the upper surface of the base portion 132 can be reduced.

Figure 9:
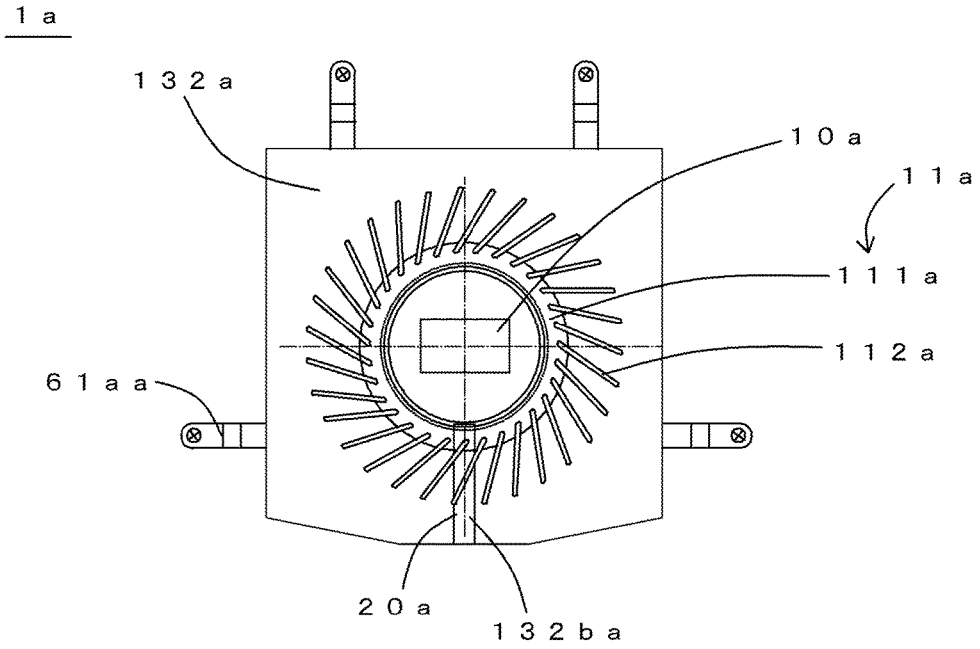
FIG. 9 is a top view of a cooling apparatus 1*a* according to a second preferred embodiment of the present invention.

FIG. 9 is a top view of a cooling apparatus 1*a* according to a second preferred embodiment of the present invention. A conducting wire guide portion 132*ba* is a groove defined in an upper surface of a base portion 132*a*, the conducting wire guide portion 132*ba* is arranged to have a radial extent greater than a circumferential width thereof, and the conducting wire guide portion 132*ba* is arranged to have a depth greater than an axial thickness of a conducting wire 20*a*. Thus, the conducting wire 20*a* is buried in the base portion 132*a* to prevent the conducting wire 20*a* from interfering with an impeller 11*a*. This makes it possible to reduce the distance between an axially lower edge of a blade 112*a* and the upper surface of the base portion 132*a*. That is, an improvement in cooling performance can be achieved. Elastic portions 61*aa* and the base portion 132*a* are defined by separate members. This contributes to reducing a bending of the base portion 132*a* caused by a deformation of any elastic portion 61*aa*, and to minimizing an effect thereof on an area of contact between a heat source 30*a* and the base portion 132*a* and a contact pressure.

Figure 10:
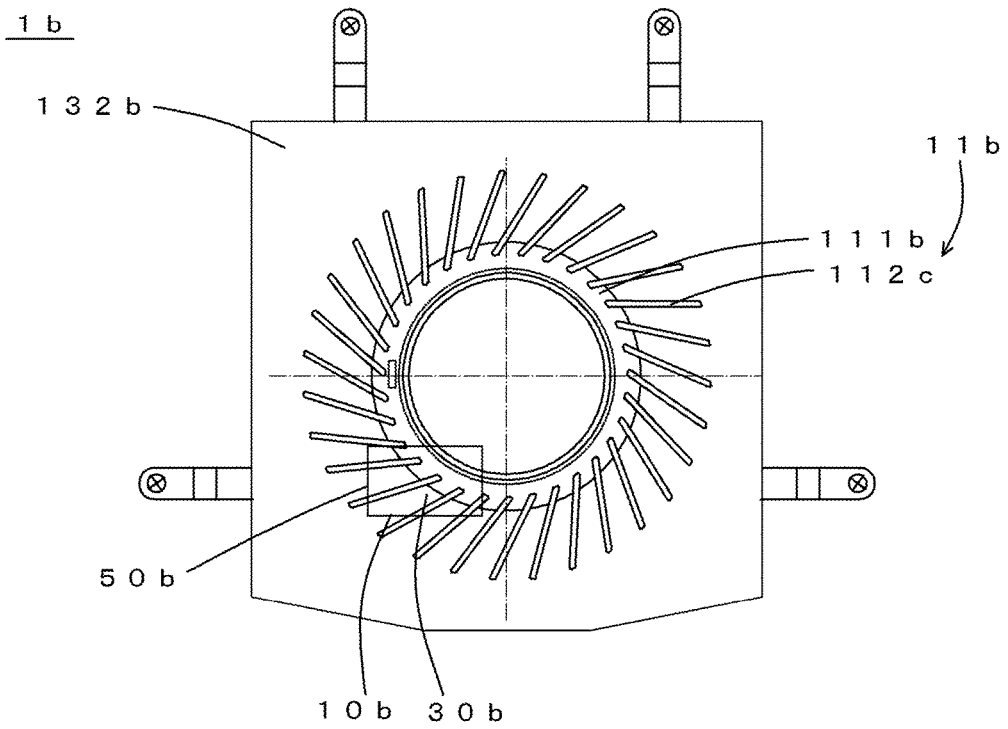
FIG. 10 is a top view of a cooling apparatus 1*b* according to a third preferred embodiment of the present invention.

FIG. 10 is a top view of a cooling apparatus 1*b* according to a third preferred embodiment of the present invention. A heat source contact portion 10*b* and a region radially outside an outer circumference of a blade support portion 111*b* and radially inside outer circumferences of a plurality of blades 112*c* are arranged to overlap at least in part with each other. This allows an air current to be concentrated under an impeller 11*b*, and makes it possible to increase the flow velocity of the air current under the impeller 11*b*. Moreover, an air passing between the blades 112*c* is allowed to directly impinge on a base portion 132*b* without undergoing an energy loss (i.e., a decrease in flow velocity). Furthermore, an air sucked from above a motor 12*b* and the impeller 11*b* passes between the blades 112*c* of the impeller 11*b* toward the base portion 132*b*. Thus, a wind strikes the heat source contact portion 10*b* to achieve an improvement in the cooling performance.

At least a portion of the heat source contact portion 10*b* may be arranged radially outward of the outer circumferences of the blades 112*c*. The flow velocity of the air gradually increases as the air travels axially downward through the impeller 11*b*. In addition, the density of the air gradually increases as the air travels radially outward through the impeller 11*b*. Therefore, the air volume is largest at a position axially below and radially outside the impeller 11*b*. In addition, at a region of the base portion 132*b* which is radially outward of an outer circumference of the impeller 11*b*, an air which has passed between the blades 112*c* flows radially outward, and the air volume is large. Therefore, an improvement in a cooling effect is achieved by arranging at least a portion of the heat source contact portion 10*b* radially outward of the outer circumferences of the blades 112*c*.

Moreover, a portion of the heat source contact portion 10*b* may be arranged radially inward of the outer circumference of the blade support portion 111*b*. More preferably, a portion of the heat source contact portion 10*b* may be arranged to axially overlap with at least a portion of a rising portion 1321. When a portion of the heat source contact portion 10*b* is arranged on the rising portion 1321, a heat is easily transferred to the rising portion 1321, resulting in an improvement in heat transfer performance and an improvement in the cooling performance. Note that at least a portion of the heat source contact portion 10*b* may be arranged radially outward of the outer circumferences of the blades 112*c* with at least a portion of the heat source contact portion 10*b* arranged radially inward of the outer circumference of the blade support portion 111*b*. Also note that at least a portion of the heat source contact portion 10*b* may be arranged radially outward of the outer circumferences of the blades 112*c* with at least a portion of the heat source contact portion 10*b* arranged on at least a portion of the rising portion 1321.

Note that the heat source contact portion 10*b* may be arranged to entirely overlap with a region radially outside the outer circumference of the blade support portion 111*b* and radially inside the outer circumferences of the blades 112*c* in a plan view. In other words, the entire heat source contact portion 10*b* may be arranged in the region radially outside the outer circumference of the blade support portion 111*b* and radially inside the outer circumferences of the blades 112*c*. An air passing between the blades 112*c* directly impinges on the base portion 132*b* without undergoing an energy loss (i.e., a decrease in flow velocity). Thus, a wind strikes the heat source contact portion 10*b* to achieve an additional improvement in the cooling performance.

The base portion 132*b* includes, in a lower surface thereof, a heat source accommodating portion 50*b* arranged to accommodate a heat source 30*b*. Inclusion of the heat source accommodating portion 50*b* in the base portion 132*b* facilitates positioning of the heat source 30*b* and the cooling apparatus 1*b* relative to each other. Note that, although the heat source accommodating portion 50*b* is defined by a portion of the lower surface of the base portion 132*b* being recessed axially upward according to the present preferred embodiment, this is not essential to the present invention. For example, a portion of the base portion 132*b*, which is defined in the shape of a plate, may be arranged to project axially upward to define the heat source accommodating portion 50*b*. Note that at least a portion of the heat source accommodating portion 50*b* is preferably arranged in a region between outer circumferential ends of the blades 112*c* and an outer circumferential end of the blade support portion 111*b*. When at least a portion of the heat source accommodating portion 50*b* is arranged in the region between the outer circumferential ends of the blades 112*c* and the outer circumferential end of the blade support portion 111*b*, an air sucked through an air inlet (not shown) passes between adjacent ones of the blades 112*c* of the impeller 11*b* toward the base portion 132*b*. When the heat source 30*b* is arranged under the blades 112*c*, a wind strikes the heat source contact portion 10*b* to improve cooling performance.

Note that each of the cooling apparatuses 1, 1*a*, and 1*b* may be modified in a variety of manners.

Note that the thickness of the base portion 132 may be arranged to be greater than the distance between the axially lower edge of any blade 112 and the upper surface of the base portion 132. Each blade 112 is arranged to extend from the rotor holder 222. The rotor holder 222 is supported by the bearing mechanism 4. Note that the plurality of blades 112 may not necessarily be arranged at regular intervals but may be arranged at irregular intervals. Also note that two or more channels having mutually different circumferential widths may be provided.

Note that the material of the base portion 132 may be aluminum, copper, an aluminum alloy, iron, an iron-base alloy (including SUS), or a resin having high thermal conductivity. For example, a portion of the base portion 132 which is opposed to the heat source may be greater in area than an area of contact between the base portion 132 and the heat source, and an object may be arranged to intervene between the base portion 132 and the heat source to increase the heat dissipation performance.

Note that the base portion 132 and the rising portion 1321 may be defined by separate members. In this case, an outer circumferential surface of the rising portion 1321 is fixed to a hole portion of the base portion 132. The rising portion 1321 is produced by subjecting a metallic member to a cutting process. Note that the rising portion 1321 may be made of a nonmetallic material. For example, the rising portion 1321 may be made of a heat conductive resin.

For example, the portion of the base portion 132 which is opposed to the heat source may be greater in area than a portion of the base portion 132 which is in contact with the heat source, and the heat dissipation performance can thereby be increased.

Note that features of the above-described preferred embodiments and the modifications thereof may be combined appropriately as long as no conflict arises.

Cooling apparatuses according to preferred embodiments of the present invention are usable to cool devices inside cases of notebook PCs and desktop PCs, to cool other devices, to supply an air to a variety of objects, and so on. Moreover, cooling apparatuses according to preferred embodiments of the present invention are also usable for other purposes.

What is claimed is:

1. A cooling apparatus comprising:

an impeller arranged to rotate about a central axis extending in a vertical direction, and including a plurality of blades arranged in a circumferential direction and a blade support portion arranged to support the plurality of blades, each of the blades having radially outward end;

a motor arranged to rotate the impeller;

a single plate-shape sheet member serving as a base portion arranged to support the motor, said single plate-shape sheet member extending in a horizontal direction perpendicular to the vertical direction, the base portion having a contour and a lower surface, the radially outward end of each of the blades being inside the contour in a plan view seen from a portion extended along the vertical direction; and a motor circuit board arranged on an upper surface of the base portion to supply a drive current to coils of the motor;

wherein of the plurality of blades, at least one pair of circumferentially adjacent blades are arranged to have a channel defined therebetween, the channel extending from axially upper edges to axially lower edges of the blades, and being arranged to be open toward the upper surface of the base portion;

wherein the base portion includes, in the lower surface thereof, a heat source contact portion wherein the heat source contact portion is a portion with which a heat source is in direct contact;

wherein at least one of the blades includes a blade edge opposed portion having an axially lower edge arranged opposite to the upper surface of the base portion; and wherein an outermost edge portion of the motor circuit board is arranged radially inward of a radially inner end portion of the blade edge opposed portion;

wherein the heat source contact portion and a region radially outside an outer circumference of the blade support portion and radially inside outer circumferences of the plurality of blades are arranged to overlap at least in part with each other in the plan view, wherein the cooling apparatus only sucks air from above the motor and the impeller, wherein thereby sucked air passes downward between the blades in the vertical direction before the air strikes the base portion, wherein the base portion changes a flow direction of the air to a radial direction to discharge the air radially, 360 degrees around the entire circumference of the base portion.

2. The cooling apparatus according to claim 1, wherein the outermost edge portion of the motor circuit board is arranged radially inward of an outer end of the blade support portion.

3. The cooling apparatus according to claim 1, wherein an axial distance between a lowermost end of the at least one blade and the upper surface of the base portion axially opposed thereto is arranged to be 800 μm or less.

4. The cooling apparatus according to claim 1, wherein the blade edge opposed portion includes a closely opposed portion where a distance between the axially lower edge of the blade edge opposed portion and the upper surface of the base portion is arranged to be 800 μm or less, the closely opposed portion extending over a quarter or more of a total length of the blade edge opposed portion.

5. The cooling apparatus according to claim 1, wherein a lower end of the blade support portion is arranged at a level higher than that of a lowermost end of the at least one blade.

6. The cooling apparatus according to claim 4, wherein the plurality of blades include one or more blades in each of which the closely opposed portion is arranged to cover a half or more of an entire region radially outside a radial middle of the blade edge opposed portion.

7. The cooling apparatus according to claim 4, wherein the plurality of blades comprises a blade having a portion radially inside the closely opposed portion, the portion spaced from the upper surface of the base portion with a distance of 800 μm or more.

8. The cooling apparatus according to claim 1, further comprising a conducting wire having one end and an opposite end, said one end electrically connected to the motor circuit board and said opposite end electrically connected to an outside;

wherein the base portion includes a conducting wire insertion hole arranged to pass therethrough in the vertical direction, and a conducting wire guide portion arranged to pass radially from the conducting wire insertion hole out to an outer circumferential end of the base portion; and wherein the conducting wire is arranged to pass through the conducting wire insertion hole, and is drawn out to the outside through the conducting wire guide portion.

9. The cooling apparatus according to claim 8, wherein the conducting wire guide portion is a groove defined in the lower surface of the base portion;

the conducting wire guide portion is arranged to have a radial extent greater than a circumferential width thereof; and the conducting wire guide portion is arranged to have a depth greater than an axial thickness of the conducting wire.

10. The cooling apparatus according to claim 8, wherein the conducting wire guide portion is a groove defined in the upper surface of the base portion;

the conducting wire guide portion is arranged to have a radial extent greater than a circumferential width thereof; and the conducting wire guide portion is arranged to have a depth greater than an axial thickness of the conducting wire.

11. The cooling apparatus according to claim 8, wherein the base portion is arranged to have a thickness greater than an axial thickness of the conducting wire.

12. The cooling apparatus according to claim 8, wherein the conducting wire is a wire on a flexible printed circuit.

13. The cooling apparatus according to claim 1, further comprising one or more elastic portions each of which is arranged to extend in the horizontal direction on a radially outer side of the plurality of blades, wherein each elastic portion includes a fixing member insertion hole arranged to pass therethrough in the vertical direction.

14. The cooling apparatus according to claim 13, wherein the number of elastic portions is three or more, and the central axis is positioned in an area surrounded by a line joining centers of the fixing member insertion holes of the elastic portions.

15. The cooling apparatus according to claim 13, wherein each elastic portion is defined integrally with the base portion.

16. The cooling apparatus according to claim 13, wherein each elastic portion is defined by a member separate from the base portion.

17. The cooling apparatus according to claim 1, wherein the motor comprises, wherein the bearing mechanism is a fluid dynamic bearing including a stationary bearing surface, a rotating bearing surface opposed thereto with a bearing gap intervening therebetween, and a lubricating oil arranged to fill the bearing gap.

18. The cooling apparatus according to claim 1, wherein the base portion includes a heat source accommodating portion arranged to have the heat source accommodated therein.

19. The cooling apparatus according to claim 8, wherein said one end of the conducting wire is located above the upper surface of the base portion, wherein the conducting wire insertion hole is arranged radially inside the blades.

20. The cooling apparatus according to claim 1, wherein $G \times S/v$ is less than 500; and $G \times W/v$ is 1000 or more;

where W (m) denotes a maximum circumferential width of the channel;

the distance G (m) denotes an average width of a gap between the upper surface of the base portion and a closely opposed portion of the at least one blade adjacent to the channel;

S (m/sec) denotes a circumferential rotation speed of a portion of the blade at which the channel has the maximum circumferential width; and v ($m^2$/sec) denotes kinematic viscosity of a gas which surrounds the cooling apparatus.

* * * * *